US011987755B2

(12) United States Patent
Subramaniyam et al.

(10) Patent No.: US 11,987,755 B2
(45) Date of Patent: May 21, 2024

(54) ADDITIVE COMPOSITION FOR REDUCING COKE AND INCREASING DISTILLATE DURING PYROLYSIS OF A FEEDSTOCK, AND METHOD OF USE THEREOF

(71) Applicant: Dorf Ketal Chemicals (India) Private Limited, Mumbai (IN)

(72) Inventors: Mahesh Subramaniyam, Singapore (SG); Shivank Menon, Mumbai (IN); Prasanta Barua, Mumbai (IN); Suhas A. Chavan, Mumbai (IN)

(73) Assignee: DORF KETAL CHEMICALS (INDIA) Private Limited, Mumbai (IN)

( * ) Notice: Subject to any disclaimer, the term of this patent is extended or adjusted under 35 U.S.C. 154(b) by 278 days.

(21) Appl. No.: 17/422,714

(22) PCT Filed: Jul. 2, 2021

(86) PCT No.: PCT/IB2021/055976

§ 371 (c)(1),
(2) Date: Jul. 13, 2021

(87) PCT Pub. No.: WO2022/162441

PCT Pub. Date: Aug. 4, 2022

(65) Prior Publication Data

US 2023/0145975 A1 May 11, 2023

(30) Foreign Application Priority Data

Jan. 29, 2021 (IN) ..... 202121004082

(51) Int. Cl.

| | |
|---|---|
| ***C10B 57/06*** | (2006.01) |
| ***C10B 43/14*** | (2006.01) |
| ***C10B 53/07*** | (2006.01) |
| ***C10B 55/00*** | (2006.01) |
| ***C10B 57/04*** | (2006.01) |

(Continued)

(52) U.S. Cl.

CPC ..... *C10B 57/06* (2013.01); *C10B 43/14* (2013.01); *C10B 53/07* (2013.01); *C10B 55/00* (2013.01); *C10B 57/045* (2013.01); *C10G 1/10* (2013.01); *C10G 9/005* (2013.01); *C10G 2300/1003* (2013.01); *C10G 2300/1077* (2013.01); *C10G 2300/206* (2013.01); *C10G 2300/4075* (2013.01)

(58) Field of Classification Search

CPC ..... C10B 57/06; C10B 43/14; C10B 53/07; C10B 55/00; C10B 57/045; C10G 1/10; C10G 9/005; C10G 2300/1003; C10G 2300/1077; C10G 2300/206; C10G 2300/4075

See application file for complete search history.

(56) References Cited

U.S. PATENT DOCUMENTS

| | | | |
|---|---|---|---|
| 4,409,093 A | 10/1983 | Bearden, Jr. et al. | |
| 5,128,023 A | 7/1992 | Reid et al. | |
| 5,858,208 A | 1/1999 | Flanders et al. | |

(Continued)

FOREIGN PATENT DOCUMENTS

| | | | |
|---|---|---|---|
| WO | 9514069 A1 | 5/1995 | |
| WO | WO-9514069 A1 * | 5/1995 | ..... C10B 55/00 |
| WO | 2004104139 A1 | 2/2004 | |

OTHER PUBLICATIONS

Foreign communication from the priority International Application No. PCT/IB2021/055976, International Search Report and Written Opinion, dated Sep. 15, 2021, 13 pages.

Foreign communication from the priority International Application No. PCT/IB2021/055976, International Preliminary Report on Patentability of the International Preliminary Examining Authority, dated May 19, 2023, 27 pages.

Foreign communication from the priority International Application No. PCT/IB2021/055976, 2nd International Search Report and Written Opinion, dated Feb. 21, 2022, 7 pages.

(Continued)

*Primary Examiner* — Ali Z Fadhel

(74) *Attorney, Agent, or Firm* — Conley Rose, P.C.; Rodney B. Carroll

(57) ABSTRACT

The present invention relates to a coke reducing additive composition capable of simultaneously (a) reducing coke formation and (b) increasing distillate yield during pyrolysis of a feedstock in the presence of a plastic material, wherein the feedstock is a vacuum residue (VR), plastic material is a waste plastic material or an olefin polymer (OP) material, or a mixture thereof, and the coke reducing additive composition comprises a naphthenate, preferably a calcium naphthenate, or sodium naphthenate, or a mixture thereof, and to a method of employing the coke reducing additive composition, and to a method of use of the coke reducing additive composition of the present invention.

Particularly, in another embodiment, the present invention relates to a coke reducing additive composition capable of simultaneously (a) reducing formation of coke deposits on walls of the processing unit; and (b) reducing fouling caused due to deposits of coke products on walls of the processing unit during pyrolysis of a feedstock in the presence of a plastic material, wherein the feedstock is a vacuum residue (VR), plastic material is a waste plastic material or an olefin polymer (OP) material, or a mixture thereof, and the coke reducing additive composition comprises a naphthenate, preferably a calcium naphthenate, or sodium naphthenate, or a mixture thereof, and to a method of employing the coke reducing additive composition, and to a method of use of the coke reducing additive composition of the present invention.

Particularly, in yet another embodiment, the present invention relates to a method to convert a waste plastic into useful chemical commodity.

13 Claims, No Drawings

(51) Int. Cl.
*C10G 1/10* (2006.01)
*C10G 9/00* (2006.01)

(56) References Cited

U.S. PATENT DOCUMENTS

| | | | | |
|---|---|---|---|---|
| 6,387,840 | B1 * | 5/2002 | Salazar | C10G 49/12 516/29 |
| 10,745,629 | B2 | 8/2020 | Kohli et al. | |
| 2021/0087473 | A1 | 3/2021 | Pradeep et al. | |

OTHER PUBLICATIONS

Foreign communication from the priority International Application No. PCT/IB2021/055976, 3rd International Search Report and Written Opinion by Telephone, dated Mar. 29, 2023, 5 pages.

* cited by examiner

ADDITIVE COMPOSITION FOR REDUCING COKE AND INCREASING DISTILLATE DURING PYROLYSIS OF A FEEDSTOCK, AND METHOD OF USE THEREOF

CROSS REFERENCE TO RELATED APPLICATIONS

This application is a filing under 35 U.S.C. 371 of International Application No. PCT/IB2021/055976 filed Jul. 2, 2021, entitled "Additive Composition for Reducing Coke and Increasing Distillate during Pyrolysis of a Feedstock, and Method of Use Thereof," which claims priority to Indian Patent Application No. 202121004082 filed Jan. 29, 2021, which applications are incorporated by reference herein in their entirety.

FIELD OF THE INVENTION

Firstly, the present invention is not for the purpose of defence.

The present invention relates to an additive composition for simultaneously reducing coke formation and increasing distillate yield during pyrolysis of a feedstock, and method of use thereof, and the additive composition may be called as a coke reducing additive composition.

Particularly, in one embodiment, the present invention relates to a coke reducing additive composition capable of simultaneously (a) reducing coke formation and (b) increasing distillate yield during pyrolysis of a feedstock in the presence of a plastic material, wherein the feedstock is a vacuum residue (VR), plastic material is a waste plastic material or an olefin polymer (OP), including polypropylene plastic (PP) material, or a mixture thereof, and the coke reducing additive composition comprises a naphthenate, preferably a calcium naphthenate, or sodium naphthenate, or a mixture thereof.

Particularly, in another embodiment, the present invention relates to method for simultaneously (a) reducing coke formation and (b) increasing distillate yield during pyrolysis of a feedstock in the presence of a plastic material, wherein the feedstock is a vacuum residue (VR), plastic material is a waste plastic material or an olefin polymer (OP), including polypropylene plastic (PP) material, or a mixture thereof, and the coke reducing additive composition comprises a naphthenate, preferably a calcium naphthenate, or sodium naphthenate, or a mixture thereof.

Particularly, in still another embodiment, the present invention relates to use of a coke reducing additive composition for simultaneously (a) reducing coke formation and (b) increasing distillate yield during pyrolysis of a feedstock in the presence of a plastic material, wherein the feedstock is a vacuum residue (VR), plastic material is a waste plastic material or an olefin polymer (OP), including polypropylene plastic (PP) material, or a mixture thereof, and the coke reducing additive composition comprises a naphthenate, preferably a calcium naphthenate, or sodium naphthenate, or a mixture thereof.

Particularly, in yet another embodiment, the present invention relates to a coke reducing additive composition capable of simultaneously (a) reducing formation of coke deposits on walls of the processing unit; and (b) reducing fouling caused due to deposits of coke products on walls of the processing unit during pyrolysis of a feedstock in the presence of a plastic material, wherein the feedstock is a vacuum residue (VR), plastic material is a waste plastic material or an olefin polymer (OP), including polypropylene plastic (PP) material, or a mixture thereof, and the coke reducing additive composition comprises a naphthenate, preferably a calcium naphthenate, or sodium naphthenate, or a mixture thereof, and to a method of employing the coke reducing additive composition, and to a method of use of the coke reducing additive composition of the present invention.

Particularly, in yet another embodiment, the present invention relates to a method to convert a waste plastic into a useful chemical commodity.

BACKGROUND OF THE INVENTION

During pyrolysis of a feedstock, such as a vacuum residue (VR), formation of a coke results in substantial decrease in yield of a distillate. For example, as per Expt. 1 of Table-I, during the pyrolysis of 100 g of a vacuum residue (VR), about 38.37 g of coke is formed, and about 61.63 g of distillate comprising about 42.02 g of liquid distillate and about 19.61 g of gas distillate is formed; similarly as per Expt. 12 of Table-III, during the pyrolysis of 100 g of a vacuum residue (VR), about 38.4 g of coke is formed, and about 61.6 g of distillate comprising about 42.6 g of liquid distillate and about 19 g of gas distillate is formed.

However, during pyrolysis of a plastic material, such as a waste plastic material or an olefin polymer (OP), including polypropylene plastic (PP) material, formation of a coke is substantially reduced resulting in substantial increase in yield of a distillate. For example, as per Expt. 2 of Table-I, during the pyrolysis of 100 g of olefin polymer (OP), including polypropylene plastic (PP) material, about 0.9 g of coke is formed, and about 99.1 g of distillate comprising about 85.48 g of liquid distillate and about 13.62 g of gas distillate is formed; similarly as per Expt. 13 of Table-III, during the pyrolysis of 100 g of olefin polymer (OP), including polypropylene plastic (PP), about 0.4 g of coke is formed, and about 99.6 g of distillate comprising about 90.5 g of liquid distillate and about 9.1 g of gas distillate is formed.

However, when pyrolysis of a feedstock is carried-out in the presence of a plastic material, then formation of coke is substantially increased again resulting in substantial decrease in yield of a distillate. For example, as per Expt. 3 of Table-I, during the pyrolysis of 50 g of a vacuum residue (VR) and 50 g of an olefin polymer (OP), including polypropylene plastic (PP) material, i.e. during pyrolysis of a combination of a VR and PP in a 1:1 wt. ratio, about 29.76 g of coke is formed, hence the yield of a distillate is substantially reduced to about 70.24 g comprising about 54.6 g of liquid distillate and about 15.64 g of gas distillate. This is unexpected behaviour of a plastic material including olefin polymer (OP), including polypropylene plastic (PP) material when processed along with a vacuum residue during the vacuum residue pyrolysis.

Therefore, a coke product is formed during pyrolysis or cracking or hydrocracking of a feedstock, or during vacuum residue (VR) pyrolysis, or during pyrolysis of vacuum residue (VR) in the presence of a plastic material, which results in decrease in yield of distillate including liquid distillate and gas distillate.

The coke formed during pyrolysis or cracking or hydrocracking of a feedstock, or during the vacuum residue (VR) pyrolysis, or during the vacuum residue (VR) pyrolysis in the presence of an olefin polymer (OP), including the polypropylene plastic (PP) material, may be referred to as pyrolytic coke which gets formed and deposited on metal surfaces in contact with a hydrocarbon feedstock undergoing pyrolytic or cracking processing.

Therefore, the coke formation is unavoidable part of a thermal pyrolysis or cracking process, and is undesirable because the yield of the distillate reduces substantially.

The U.S. Pat. No. 10,745,629 to Kirtika Kohli et al discloses a process for processing vacuum residues, but the disclosure and teaching of this patent are limited to process for making a waste plastic as a hydrogen donating agent for hydro-conversion of heavy crude oil and vacuum residues.

The US patent publication no. US 2021/087473A1 to Pradeep et al discloses a process for conversion of a waste plastic into lighter distillate products by thermal cracking of a mixture of a fresh hydrocarbon feedstock and the waste plastic to obtain a light Coker gasoil, a heavy Coker gasoil and a coke fuel oil along with a vapor fraction and separating into fuel gas, LPG and naphtha.

The U.S. Pat. No. 4,409,093 to Roby Bearden, Jr. et al discloses a method for decreasing the amount of coke produced during the cracking of hydrocarbon feedstock to lower molecular weight products by processing a feedstock containing at least two metal contaminants selected from the class consisting of Ni, V, and Fe to avoid formation of deposits of these contaminants on the catalyst by partially passivating the catalyst.

The U.S. Pat. No. 5,128,023 to Dwight K. Reid et al discloses a method and compositions for inhibiting the formation and deposition of pyrolytic coke on metal surfaces in contact with a hydrocarbon feedstock undergoing pyrolytic processing by adding a coke inhibiting amount of a combination of: a boron compound and a dihydroxybenzene compound, specifically ammonium biborate and hydroquinone in the presence of glycollic-type solvents and water along with a co-solvent such as butyl carbitol or ethylene glycol.

The U.S. Pat. No. 5,858,208 to Robert L. Flanders et al discloses a method for improving conversion during fluidized catalytic cracking of a feed stream containing vanadium by adding an effective amount of a composition comprising one overbase complex of a magnesium or aluminium salt and an organic acid (fatty acid) complexing agent, and an antimony compound.

However, the prior art is silent about a technical solution to the presently faced problems of increase in coke formation and simultaneous decrease in yield of the distillate during pyrolysis of a feedstock or a plastic material or a mixture of a feedstock and a plastic material, and to convert a waste plastic into a useful chemical commodity.

Therefore, the industry desires to have an additive and a method to simultaneously (a) reduce coke formation and (b) increase yield of distillate during cracking of a feedstock, during vacuum residue (VR) pyrolysis, or during vacuum residue (VR) pyrolysis in the presence of a plastic material including a waste plastic material or an olefin polymer (OP), including polypropylene plastic (PP) material, and (c) to reduce to formation of coke deposits on walls of the processing unit, and (d) to reduce fouling caused due to deposits of coke products on walls of the processing unit, and to convert a waste plastic into a useful chemical commodity.

SUMMARY OF THE INVENTION

Accordingly, aim of the present invention is to solve the above-discussed problems of the prior art, i.e. to provide an additive and a method to simultaneously (a) reduce coke formation and (b) increase yield of distillate during pyrolytic or cracking processing of a feedstock, during vacuum residue (VR) pyrolysis, or during vacuum residue (VR) pyrolysis in the presence of a plastic material including a waste plastic material or an olefin polymer (OP), including polypropylene plastic (PP) material, and (c) to reduce to formation of coke deposits on walls of the processing unit, and (d) to reduce fouling caused due to deposits of coke products on walls of the processing unit, and to convert a waste plastic into a useful chemical commodity.

OBJECTS OF THE INVENTION

Therefore, main object of the present invention is to provide a coke reducing additive composition and a method of employing thereof and a method of use thereof to simultaneously (a) reduce coke formation and (b) increase yield of distillate during pyrolytic or cracking processing of a feedstock, or during vacuum residue (VR) pyrolysis, or during vacuum residue (VR) pyrolysis in the presence of a plastic material including a waste plastic material or an olefin polymer (OP), including polypropylene plastic (PP) material, and (c) to reduce to formation of coke deposits on walls of the processing unit, and (d) to reduce fouling caused due to deposits of coke products on walls of the processing unit, which may also be referred to as a Coker unit, a pyrolytic furnace, a steam cracking furnace, and to convert a waste plastic into useful chemical commodity.

Other objects and advantages of the present invention will become more apparent from the following description when read in conjunction with examples, which are not intended to limit scope of present invention.

DETAILED DESCRIPTION

With aim to solve the above-discussed problems of the prior art, i.e. problem of increase in coke formation, and problem of decrease in yield of distillate, and problem of formation of deposits of coke on metal surfaces of a pyrolysis or a cracking furnace, and problem of fouling caused due to deposits of coke product on metal surfaces of a pyrolysis or a cracking furnace, the inventors have found that addition of a naphthenate, preferably of sodium naphthenate or a sodium salt or a sodium salt of an organic acid, and more preferably of calcium naphthenate or a calcium salt or a calcium salt of an organic acid in a feedstock, or in a plastic material, or in a combination of a feedstock and a plastic material, surprisingly and unexpectedly, simultaneously: (a) reduces coke formation and (b) increases yield of distillate during pyrolytic or cracking processing of a feedstock, or of a plastic material, or of a combination of a feedstock and a plastic material, or particularly during vacuum residue (VR) pyrolysis, or more particularly during vacuum residue (VR) pyrolysis in the presence of a plastic material including a waste plastic material or an olefin polymer (OP), including polypropylene plastic (PP) material, and (c) reduces formation of coke deposits on walls of the processing unit, and (d) reduces fouling caused due to deposits of coke products on walls of the processing unit, and (e) converts the waste plastic into a useful chemical commodity.

Accordingly, in first embodiment, the present invention relates to a coke reducing additive composition for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of a material comprising:

(i) a feedstock, (ii) a plastic material, or (iii) a feedstock in the presence of a plastic material;

wherein the coke reducing additive composition comprises a naphthenate, preferably sodium naphthenate or a sodium salt or a sodium salt of an organic acid, and more preferably calcium naphthenate or a calcium salt or a calcium salt of an organic acid, or a mixture thereof.

Accordingly, in accordance with a preferred embodiment of the first embodiment, it relates to a coke reducing additive composition for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of: a feedstock in the presence of a plastic material;

wherein the feedstock is a vacuum residue, preferably the feedstock is a vacuum residue comprising asphaltene;

wherein the plastic material is a waste plastic material, an olefin polymer (OP), or a mixture thereof, and wherein the coke reducing additive composition comprises a naphthenate, preferably sodium naphthenate or a sodium salt or a sodium salt of an organic acid, and more preferably calcium naphthenate or a calcium salt or a calcium salt of an organic acid, or a mixture thereof.

In accordance with the present preferred embodiment of the present invention, the olefin polymer (OP) includes a polypropylene plastic (PP) material.

Accordingly, in accordance with a more preferred embodiment of the first embodiment, it relates to a coke reducing additive composition for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of: a feedstock in the presence of a plastic material;

wherein the feedstock is a vacuum residue comprising asphaltene;

wherein the plastic material is a waste plastic material, an olefin polymer (OP) including a polypropylene plastic (PP) material, or a mixture thereof; and wherein the coke reducing additive composition comprises calcium naphthenate.

Accordingly, in second embodiment, the present invention relates to a method for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of a material comprising:

(i) a feedstock, (ii) a plastic material, or (iii) a feedstock in the presence of a plastic material;

wherein the method comprises adding a coke reducing additive composition of the present invention in a processing unit containing the feedstock, the plastic material, or the feedstock in the presence of the plastic material; and wherein the coke reducing additive composition comprises a naphthenate, preferably sodium naphthenate or a sodium salt or a sodium salt of an organic acid, and more preferably calcium naphthenate or a calcium salt or a calcium salt of an organic acid, or a mixture thereof.

Accordingly, in accordance with a preferred embodiment of the second embodiment, the present invention relates to a method for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of: a feedstock in the presence of a plastic material;

wherein the feedstock is a vacuum residue, preferably the feedstock is a vacuum residue comprising asphaltene;

wherein the plastic material is a waste plastic material, an olefin polymer (OP), or a mixture thereof;

wherein the method comprises adding a coke reducing additive composition of the present invention in a processing unit containing the feedstock in the presence of the plastic material; and wherein the coke reducing additive composition comprises a naphthenate, preferably sodium naphthenate or a sodium salt or a sodium salt of an organic acid, and more preferably calcium naphthenate or a calcium salt or a calcium salt of an organic acid, or a mixture thereof.

In accordance with the present preferred embodiment of the present invention, the olefin polymer (OP) includes a polypropylene plastic (PP) material.

Accordingly, in accordance with a more preferred embodiment of the second embodiment, the present invention relates to a method for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of: a feedstock in the presence of a plastic material;

wherein the feedstock is a vacuum residue comprising asphaltene;

wherein the plastic material is a waste plastic material, an olefin polymer (OP) including a polypropylene plastic (PP) material, or a mixture thereof, and wherein the method comprises adding a coke reducing additive composition of the present invention in a processing unit containing the feedstock in the presence of the plastic material; and wherein the coke reducing additive composition comprises calcium naphthenate.

Accordingly, in third embodiment, the present invention relates to a use of a coke reducing additive composition for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of a material comprising:

(i) a feedstock, (ii) a plastic material, or (iii) a feedstock in the presence of a plastic material;

wherein the use comprises treating the feedstock, the plastic material, or the feedstock in the presence of the plastic material with the coke reducing additive composition of the present invention in a processing unit containing the feedstock, the plastic material, or the feedstock in the presence of the plastic material; and wherein the coke reducing additive composition comprises a naphthenate, preferably sodium naphthenate or a sodium salt or a sodium salt of an organic acid, and more preferably calcium naphthenate or a calcium salt or a calcium salt of an organic acid, or a mixture thereof.

Accordingly, in accordance with a preferred embodiment of the third embodiment, the present invention relates to a use of a coke reducing additive composition for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of a feedstock in the presence of a plastic material;

wherein the feedstock is a vacuum residue, preferably the feedstock is a vacuum residue comprising asphaltene;

wherein the plastic material is a waste plastic material, an olefin polymer (OP), or a mixture thereof;

wherein the use comprises treating the feedstock in the presence of the plastic material with the coke reducing additive composition of the present invention in a processing unit containing the feedstock and the plastic material; and wherein the coke reducing additive composition comprises a naphthenate, preferably sodium naphthenate or a sodium salt or a sodium salt of an organic acid, and more preferably calcium naphthenate or a calcium salt or a calcium salt of an organic acid, or a mixture thereof.

In accordance with the present preferred embodiment of the present invention, the olefin polymer (OP) includes a polypropylene plastic (PP) material.

Accordingly, in accordance with a more preferred embodiment of the third embodiment, the present invention relates to a use of a coke reducing additive composition for simultaneously:

(a) reducing coke formation, and (b) increasing yield of distillate;

(c) converting a waste plastic into useful chemical commodity; and (d) reducing formation of coke deposits on walls of the processing unit, and (e) reducing fouling caused due to deposits of coke products on walls of the processing unit, during pyrolytic or cracking processing of a feedstock in the presence of a plastic material;

wherein the feedstock is a vacuum residue comprising asphaltene;

wherein the plastic material is a waste plastic material, an olefin polymer (OP) including a polypropylene plastic (PP) material, or a mixture thereof; and wherein the use comprises treating the feedstock in the presence of the plastic material with the coke reducing additive composition of the present invention in a processing unit containing the feedstock and the plastic material; and wherein the coke reducing additive composition comprises calcium naphthenate.

It may be noted that regarding the second and third embodiments, the scope of the present invention may not be limited by the manner to mix the feedstock and plastic material and addition of the additive of the present invention. Therefore, the mixing of the feedstock and the plastic material and addition of the present additive may be carried-out in any manner known to a person skilled in the art.

In accordance with one of the embodiments of the present invention, a viable economic route to enhance the liquid distillate product yield and to reduce the coke formation during the pyrolysis of the feedstock, preferably of the vacuum residue feedstock, or during the pyrolysis of the plastic material, preferably of the waste plastic material or the olefin polymer including polypropylene plastic material, is to add to the vacuum residue feedstock, and the plastic material at the beginning of the pyrolysis, which has been surprisingly and unexpectedly found to enhance the liquid distillate product yield, but has also been found to simultaneously lower the yield of the solid coke fraction.

It may be noted that the scope of present invention may not be limited by the feedstock or a composition thereof.

However, in accordance with one of the embodiments of the present invention, the feedstock of the above-described embodiments is a hydrocarbon feedstock.

In accordance with one of the preferred embodiments of the present invention, the feedstock may be selected from the group comprising crude oil, vacuum residue, atmospheric residue, asphalted pitch, shale oil, coal tar, clarified oil, residual oils, heavy waxy distillates, foots oil, slop oil or mixture thereof.

In accordance with one of the more preferred embodiments of the present invention, the feedstock is a vacuum residue feedstock.

In accordance with one of the even more preferred embodiments of the present invention, the feedstock is a vacuum residue feedstock comprising asphaltene.

It may be noted that the scope of present invention may not be limited by the selection of a plastic material.

However, in accordance with one of the embodiments of the present invention, the plastic material of the above-described embodiments may be selected from a group comprising a waste plastic material, an olefin polymer (OP), a low density polyethylene (LDPE), a high density polyethylene (HDPE), a mix plastic, a polystyrene, a polypropylene, a polyethylene, or a mixture thereof.

In accordance with one of the preferred embodiments of the present invention, the plastic material is a waste plastic material, an olefin polymer (OP), or a mixture thereof.

In accordance with one of the more preferred embodiments of the present invention, the olefin polymer (OP) includes a polypropylene plastic (PP) material.

In accordance with one of the more preferred embodiments of the present invention, the waste plastic material includes a packaging material.

In accordance with one of the embodiments of the present invention, the olefin polymer (OP) of the above-described embodiments includes a polymer made from monomers. For example, the olefin polymer (OP) includes a polymer made from, without limitation, ethylene, propylene, butane, butadiene. The olefin polymer (OP) may be prepared by any known polymerisation method, which may preferably be either a Ziegler process or a free radical process.

It may be noted that the scope of present invention may not be limited by the selection of a processing unit.

However, in accordance with one of the embodiments of the present invention, the processing unit of the above-described embodiments may be a pyrolytic furnace, a Coker unit, a Micro-Coker reactor, a steam cracking furnace, or any furnace for pyrolysis of a feedstock.

In accordance with one of the embodiments of the present invention, the amount of the coke reducing additive of the present invention may vary as per amounts of the feedstock and the plastic material being processed.

In accordance with one of the preferred embodiments of the present invention, the coke reducing additive of the present invention may be added to a processing unit for processing the feedstock, the plastic material, or the feedstock in the presence of a plastic material, preferably for processing the vacuum residue in the presence of an olefin polymer (OP) including the polypropylene plastic material in an amount selected from the group comprising:

a) about 1 ppm to about 5000 ppm,
b) about 5 ppm to about 3000 ppm,
c) about 5 ppm to about 2000 ppm,
d) about 5 ppm to about 1000 ppm, or
e) about 5 ppm to about 500 ppm.

In accordance with the present invention, its scope may not be limited to the amount of the feedstock and the plastic material, because the present invention may be applied to any processing unit processing any amount of the feedstock, or the plastic material, or the feedstock in the presence of the plastic material.

However, in accordance with one of the embodiments of the present invention, the feedstock, preferably the vacuum residue and the plastic material, preferably the olefin polymer (OP) may be added or mixed in a weight ratio of the feedstock to the plastic material varying from about 0.1 to 99.9 to about 99.9 to 0.1.

It may be noted that as per the present invention, the pyrolysis includes thermal pyrolysis, hydrocracking or cracking of a feedstock.

It may be noted that as per the present invention, the amount referred in the present invention including the Tables may be referred to as in "wt. %" or "% by wt.".

Further embodiments of the present invention would be apparent from the accompanying examples, which are for the illustration purpose and not intended to limit scope of the present invention.

EXAMPLES

In the following examples, a vacuum residue (VR) is charged with or without olefin polymer (OP) including polypropylene plastic (PP) material into a reactor of a Coker unit. For a blank example, no additive; and for an invention example, a coke reducing additive of the present invention is added. The composition of the experiment, the amount of coke formed, the amount of liquid distillate formed, and the amount of gas distillate formed for each of the Examples are given in the following tables—Table-I, Table-II, and Table-III. As one of the exemplary embodiment, the experiments are carried out as follows:

However, in accordance with one of the exemplary embodiments of the present invention, a feedstock may be first charged in a reactor of a processing unit provided with a transfer tube to facilitate passage of volatile lower boilers into collectors for liquid distillates and gaseous fractions, temperature of the reactor may be raised to a temperature of greater than about 600 deg C. to about 700 deg C. and inner temperature within the reactor may be maintained between about 440- about 500 deg C. during the course of reaction, in a manner that the transfer tube capable of facilitating passage of the volatile lower boilers (preferably of temperature of <370 deg C.) into the collectors for the liquid distillates and the gaseous fractions, is maintained at a temperature of about 240 deg C. to about 245 deg C., during the pyrolysis. A typical processing time may be maintained at about 4 h, preferably under stirring at about 195 rpm to about 205 rpm, and the reactor is then cooled to a temperature of about 140 deg C. or low, preferably to a room temperature (RT), and the liquid distillate is separated and analyzed (for example by HT-GC, i.e. high temperature-gas chromatography), and the gas fraction is also quantified (for example by weight basis).

In accordance with one of the preferred exemplary embodiments of the present invention, the temperature of the reactor is raised to greater than about 600 deg C. and inner temperature within the reactor is maintained between about 440-500 deg C. during the course of reaction. A transfer tube facilitating passage of volatile lower boilers (<about 370 deg C.) into the collectors for liquid distillates and gaseous fractions is maintained at 245 deg C., during the experiment. Typical reaction or run time is maintained at about 4 h under stirring at about 200 rpm. Post reaction or run, the reactor is cooled to about 140 deg C.

For experimental results, a reference may be drawn to the experimental data presented in the following tables: Table-I, Table-II, and Table-III, which are not intended to limit the scope of the present invention.

measures Saturates, Asphaltenes, Resins, Aromatics in a heavy crude oil, distillate and feedstock.

In the present examples, the SARA analysis has been carried out by ASTM D2007 method.

The polypropylene (PP) having a melting point of about 103 deg C. is used. It may be noted that the polypropylene (like other polymers) may have a range of melting points. In the present examples, the melting point of the PP used was measured by differential scanning calorimetric evaluation and by this technique, the melting point of PP was found to be about 103 deg C.

TABLE I

| | Composition | | | | | | |
|---|---|---|---|---|---|---|---|
| Expt. Category | Vacuum Residue (VR) (g) | Polypropylene Plastic material (PP) (g) | Additive (ppm) (Activity 50%) | Coke (% by wt) | Liquid Distillate (% by wt) | Gas Distillate (% by wt) | Total Distillates Formed (% by wt) |
| Expt. 1 | 100 | Nil | Nil | 38.37 | 42.02 | 19.61 | 61.63 |
| Expt. 2 | Nil | 100 | Nil | 0.9 | 85.48 | 13.62 | 99.1 |
| Expt. 3 | 50 | 50 | Nil | 29.76 | 54.6 | 15.64 | 70.24 |
| Expt. 4 - Invention Additive is Ca Naphthenate (Present Invention) | 50 | 50 | 9.8 | 25.0 | 58.3 | 16.7 | 75.00 |
| Expt. 5 - Invention Additive is Ca Naphthenate (Present Invention) | 50 | 50 | 19.6 | 22.3 | 58.9 | 18.8 | 77.77 |

Composition of the VR Feedstock Used in Experiments of Table-I and Table-II is:

| | SARA Analysis (wt %) | | | |
|---|---|---|---|---|
| MCR (wt %) | Saturate | Asphaltene | Resin | Arometic |
| 20.48 | 10.88 | 23.21 | 27.68 | 38.22 |

Composition of the VR Feedstock Used in Experiments of Table-III is:

| | SARA Analysis (wt %) | | | |
|---|---|---|---|---|
| MCR (wt %) | Saturate | Asphaltene | Resin | Arometic |
| 21.24 | 14.10 | 21.37 | 31.90 | 32.63 |

The vacuum reside (VR) feedstock was arranged from a petroleum refinery and characterization was carried out by way of MCR and SARA analysis.

MCR is Micro Carbon Residue, and is a laboratory test used to determine the amount of carbonaceous residue formed after evaporation and pyrolysis of petroleum materials under certain conditions. The test is used to provide some indication of a material's coke-forming tendency.

In the present examples, the MCR has been measured by ASTM D4530 method.

SARA Analysis: Hydrocarbon samples are tested by Intertek for Saturates, Asphaltenes, Resins and Aromatics (SARA). SARA analysis of heavy crudes is carried-out for heavy oils, including vacuum distillates, atmospheric and vacuum residues, bitumens and asphalts. SARA oil testing It may be noted that when effect of PP in VR pyrolysis was evaluated, specifically on the amount of distillate products post-pyrolysis, for example for a VR:PP combination in 1:1 wt. ratio, there was an unexpected increase in the distillate amount from 61.63 g (in absence of PP and/or additive) to around 70.24 g in the presence of PP (compare Expt. 1 and 3). This indicates that PP promotes enhancement of the distillate amount, during the pyrolysis of VR. Besides this, PP also allows for the reduction of coke, from around 38.37 g (in absence of PP) to 29.76 g (in the presence of PP).

However, when the additive of the present invention, i.e. Ca Naphthenate was added to a VR:PP combination in 1:1 wt. ratio, it was surprisingly and unexpectedly observed that it results in further increase of the total distillate formation by increasing the formation of the liquid distillate and the gas distillate, and further reduction of coke formation—re Expt. 4 and Expt. 5 vs. Expt. 3.

Therefore, the experimental data in Table-I demonstrates that the present additive i.e. Ca Naphthenate has surprising and unexpected technical advantage to reduce the coke formation and increase the total distillate formation by increasing the formation of the liquid distillate and the gas distillate, hence the composition comprising the VR, the PP and the present additive i.e. Ca Naphthenate has a synergistic effect during pyrolysis of VR in presence of PP.

Further, the reduction in coke formation results in reduction of formation of deposits hence, fouling on the metal surfaces of the processing unit is either avoided or is reduced.

TABLE II

| Expt. Category | Composition: Vacuum Residue (VR) (g) | Composition: Polypropylene Plastic material (PP) (g) | Composition: Additive (ppm) (Activity 50%) | Coke (% by wt) | Liquid Distillate (% by wt) | Gas Distillate (% by wt) | Total Distillates Formed (% by wt) |
|---|---|---|---|---|---|---|---|
| Expt. 6 | 90 | 10 | Nil | 40.58 | 42.4 | 17.02 | 59.42 |
| Expt. 7 - Invention Additive is Ca Naphthenate (Present Invention) | 90 | 10 | 9.8 | 37.01 | 44.43 | 18.56 | 62.99 |
| Expt. 8 | 95 | 5 | Nil | 42.33 | 38.92 | 18.75 | 57.67 |
| Expt. 9 - Invention Additive is Ca Naphthenate (Present Invention) | 95 | 5 | 9.8 | 40.36 | 40.77 | 18.87 | 59.64 |
| Expt. 10 | 98 | 2 | Nil | 41.79 | 38.67 | 19.54 | 58.21 |
| Expt. 11- Invention Additive is Ca Naphthenate (Present Invention) | 98 | 2 | 9.8 | 39.97 | 40.1 | 19.93 | 60.03 |

The experimental data in Table-II confirms that the claimed additive Ca Naphthenate has surprising and unexpected technical advantage to simultaneously reduce the coke formation and increase the total distillates formation by increasing the formation of the liquid distillate and the gas distillate—re experimental data of Expt. 7 vs. Expt. 6, Expt. 9 vs. Expt. 8, and Expt. 11 vs. Expt. 10.

It may be noted that in the Expts. 7, 9 and 11 the amount of present additive has been kept constant at 9.8 ppm, however, the VR/PP ratios are different for the Expts. 6-7, 8-9 and 10-11, and these experiments confirm synergistic effect of the present additive composition.

Further, the reduction in coke formation results in reduction of formation of deposits hence, fouling on the metal surfaces of the processing unit is either avoided or is reduced.

The experimental data in Table-III confirms that the claimed additive Ca Naphthenate and Na Naphthenate have a surprising and unexpected technical advantage to simultaneously reduce the coke formation and increase the total distillates formation—re experimental data of Expt. 15 and 16 vs. Expt. 14.

Further, the reduction in coke formation results in reduction of formation of deposits hence, fouling on the metal surfaces of the processing unit is either avoided or is reduced.

As per one of the embodiments of the present invention, the Expt. data of Expt. no. 2 in Table-I [and Expt. No. 13 in Table-III] confirms that during pyrolysis of 100 g of the plastic material comprising an olefin polymer like PP in absence of Ca Naphthenate additive allows formation of various liquid distillate fractions as mentioned in below

TABLE III

| Expt. Category | Composition: Vacuum Residue (VR) (g) | Composition: Polypropylene Plastic material (PP) (g) | Composition: Additive (ppm) | Coke (% by wt) | Liquid Distillate (% by wt) | Gas Distillate (% by wt) | Total Distillates Formed (% by wt) |
|---|---|---|---|---|---|---|---|
| Expt. 12 | 100 | Nil | Nil | 38.4 | 42.6 | 19 | 61.6 |
| Expt. 13 | Nil | 100 | Nil | 0.4 | 90.5 | 9.1 | 99.6 |
| Expt. 14 | 98 | 2 | Nil | 37.3 | 46 | 16.7 | 62.7 |
| Expt. 15 - Invention Additive is Ca Naphthenate (Present Invention) | 98 | 2 | 4.9 | 35.5 | 46.3 | 18.2 | 64.5 |
| Expt. 16 - Invention Additive is Na Naphthenate (Present Invention) | 98 | 2 | 4.9 | 35.7 | 46.3 | 18 | 64.3 |
| Expt. 17 - Comparative Additive is Fe Naphthenate (Comparative Example) | 98 | 2 | 4.9 | 38.7 | 40.9 | 20.4 | 61.3 |
| Expt. 18 - Comparative Additive is Mg Naphthenate (Comparative Example) | 98 | 2 | 4.9 | 38.2 | 44.2 | 17.6 | 61.8 |

Table-IV, hence in one embodiment, the present invention also relates to a process to convert waste plastic into useful products.

TABLE IV

| | |
|---|---|
| Feed | 100% PP |
| Amount of Liquid distillate obtained | 85.48 |
| Composition of product fractions in liquid distillate* | Wt (%) |
| Naphtha | 20 |
| Kerosene | 21 |
| Diesel | 35 |
| Fuel Oil | 24 |

As can be observed from the foregoing experimental data, the technical advantages have been achieved by the present invention.

Based on the above-discussed experimental results of the present invention, the inventors, without being bound by the theory or the mechanism, have found that the coke reducing additive of the present invention has provided a technical solution to the existing technical problems of the industry to simultaneously:

(a) reduce coke formation;
(b) increase yield of distillate;
(c) convert a waste plastic into a useful chemical commodity;
(d) reduce formation of coke deposits on walls of the processing unit; and
(e) reduce fouling caused due to deposits of coke products on walls of the processing unit, during the pyrolysis of a feedstock, or a plastic material, or a feedstock in the presence of a plastic material, and still being an economical.

The invention claimed is:

1. A method for simultaneously:
(a) reducing coke formation;
(b) increasing yield of distillate;
(c) converting a waste plastic into a useful chemical commodity;
(d) reducing formation of coke deposits on walls of the processing unit; and
(e) reducing fouling caused due to deposits of coke products on walls of the processing unit,
during a pyrolytic or cracking processing of a material comprising:
(i) a feedstock in the presence of a plastic material;
wherein the method comprises a step of adding a coke reducing additive composition in a processing unit containing the feedstock in the presence of the plastic material;
wherein the coke reducing additive composition comprises a sodium naphthenate, calcium naphthenate or a mixture thereof;
wherein the plastic material includes a waste plastic material.

2. The method as claimed in claim 1, wherein the coke reducing additive composition comprises sodium naphthenate.

3. The method as claimed in claim 1, wherein the coke reducing additive composition comprises calcium naphthenate.

4. The method as claimed in claim 1, wherein the feedstock is selected from the group comprising crude oil, vacuum residue, atmospheric residue, asphalted pitch, shale oil, coal tar, clarified oil, residual oils, heavy waxy distillates, foots oil, slop oil or mixture thereof, preferably the feedstock is a vacuum residue feedstock, wherein the vacuum residue feedstock comprises asphaltene.

5. The method as claimed in claim 1, wherein the plastic material is selected from a group comprising a waste plastic material, an olefin polymer (OP), a low density polyethylene (LDPE), a high density polyethylene (HDPE), a mix plastic, a polystyrene, a polypropylene, a polyethylene, or a mixture thereof, preferably the plastic material is a waste plastic material, an olefin polymer (OP), or a mixture thereof, wherein the olefin polymer (OP) comprises a polypropylene plastic (PP) material.

6. The method as claimed in claim 1, wherein the coke reducing additive composition is added to the processing unit in an amount varying from:
a) about 1 ppm to about 5000 ppm,
b) about 5 ppm to about 3000 ppm,
c) about 5 ppm to about 2000 ppm,
d) about 5 ppm to about 1000 ppm, or
e) about 5 ppm to about 500 ppm.

7. A use of a coke reducing additive composition for simultaneously:
(a) reducing coke formation;
(b) increasing yield of distillate;
(c) converting a waste plastic into a useful chemical commodity;
(d) reducing formation of coke deposits on walls of the processing unit; and
(e) reducing fouling caused due to deposits of coke products on walls of the processing unit,
during a pyrolytic or cracking processing of a material comprising:
(i) a feedstock in the presence of a plastic material;
wherein the use comprises treating the feedstock in the presence of the plastic material with a coke reducing additive composition in a processing unit containing the feedstock in the presence of the plastic material;
wherein the coke reducing additive composition comprises a sodium naphthenate, calcium naphthenate or a mixture thereof.

8. The use as claimed in claim 7, wherein the coke reducing additive composition comprises sodium naphthenate.

9. The use as claimed in claim 7, wherein the coke reducing additive composition comprises calcium naphthenate.

10. The use as claimed in claim 7, wherein the feedstock is selected from the group comprising crude oil, vacuum residue, atmospheric residue, asphalted pitch, shale oil, coal tar, clarified oil, residual oils, heavy waxy distillates, foots oil, slop oil or mixture thereof, preferably the feedstock is a vacuum residue feedstock, wherein the vacuum residue feedstock comprises asphaltene.

11. The use as claimed in claim 7, wherein the plastic material is selected from a group comprising a waste plastic material, an olefin polymer (OP), a low density polyethylene (LDPE), a high density polyethylene (HDPE), a mix plastic, a polystyrene, a polypropylene, a polyethylene, or a mixture thereof, preferably the plastic material is a waste plastic material, an olefin polymer (OP), or a mixture thereof, wherein the olefin polymer (OP) comprises a polypropylene plastic (PP) material.

12. The use as claimed in claim 7, wherein the coke reducing additive composition is used in an amount varying from:
a) about 1 ppm to about 5000 ppm,
b) about 5 ppm to about 3000 ppm,
c) about 5 ppm to about 2000 ppm, d) about 5 ppm to about 1000 ppm, or e) about 5 ppm to about 500 ppm.

13. A method for converting a waste plastic material into a useful chemical commodity by pyrolysis of a waste plastic material;

wherein the method comprises a step of adding a coke reducing additive composition in a processing unit containing the feedstock in the presence of the waste plastic material;

wherein the coke reducing additive composition comprises a sodium naphthenate, calcium naphthenate or a mixture thereof.

* * * * *